US010313824B2

(12) United States Patent
Saito

(10) Patent No.: US 10,313,824 B2
(45) Date of Patent: Jun. 4, 2019

(54) AUDIO PROCESSING DEVICE FOR PROCESSING AUDIO, AUDIO PROCESSING METHOD, AND PROGRAM

(71) Applicant: CANON KABUSHIKI KAISHA, Tokyo (JP)

(72) Inventor: Katsumi Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/979,017

(22) Filed: May 14, 2018

(65) Prior Publication Data

US 2018/0338216 A1 Nov. 22, 2018

(30) Foreign Application Priority Data

May 19, 2017 (JP) ..... 2017-099887

(51) Int. Cl.

| | |
|---|---|
| ***H04R 5/00*** | (2006.01) |
| ***H04S 7/00*** | (2006.01) |
| ***H04R 1/22*** | (2006.01) |
| ***H04R 5/04*** | (2006.01) |

(52) U.S. Cl.

CPC ..... *H04S 7/307* (2013.01); *H04R 1/22* (2013.01); *H04R 5/04* (2013.01)

(58) Field of Classification Search

CPC . H04S 7/307; H04S 3/00; H04S 3/002; H04S 5/00; H04S 1/00; H04S 2420/07; H04S 2400/01; H04R 1/22; H04R 5/04; H04R 5/02; H04R 3/04; H04R 2499/11; H03G 5/165

USPC ..... 381/98, 99, 11, 1, 17–21

See application file for complete search history.

(56) References Cited

U.S. PATENT DOCUMENTS

| | | | | |
|---|---|---|---|---|
| 2008/0219470 | A1* | 9/2008 | Kimijima | H04S 1/002 381/92 |
| 2010/0027810 | A1 | 2/2010 | Marton | |
| 2014/0185833 | A1 | 7/2014 | Ikeda | |

FOREIGN PATENT DOCUMENTS

| | | | |
|---|---|---|---|
| JP | 2001189999 | A | 7/2001 |

* cited by examiner

*Primary Examiner* — Xu Mei
*Assistant Examiner* — Ammar T Hamid
(74) *Attorney, Agent, or Firm* — Canon U.S.A., Inc. IP Division

(57) ABSTRACT

An audio processing device includes first and second LPFs for outputting low-frequency components of a first right channel signal and a first left channel signal; a first subtracter for subtracting an output signal of the second LPF from the first right channel signal, thereby outputting a second right channel signal; a second subtracter for subtracting an output signal of the first LPF from the first left channel signal, thereby outputting a second left channel signal; a third LPF for outputting a low-frequency component of a signal obtained by addition of the first right channel signal and the first left channel signal; a first amplifier for amplifying an output signal of the third LPF; and adders for adding up the second right channel signal and an output signal of the first amplifier and to add up the second left channel signal and the output signal of the first amplifier.

21 Claims, 9 Drawing Sheets

AUDIO PROCESSING DEVICE FOR PROCESSING AUDIO, AUDIO PROCESSING METHOD, AND PROGRAM

BACKGROUND

Field of the Disclosure

The present disclosure relates to an audio processing device for processing audio, an audio processing method, and a program.

Description of the Related Art

A two-channel stereo audio collection device with directional characteristics in a right-to-left direction of the device has been known. The method for providing these directional characteristics is roughly classified into the method for collecting sound by means of a directional microphone and the method for generating directional characteristics from audio signals collected by multiple non-directional microphones by stereo feeling emphasis processing. The method using the directional microphone includes, for example, the method for collecting sound by two unidirectional microphones arranged to face in directions targeted for the directional characteristics, and the method for collecting sound for two opposing directions by a single bidirectional microphone. The directional microphone has an advantage that the directional characteristics are acoustically provided, and on the other hand, has characteristics that noise is easily generated due to vibration. Thus, a method has been employed, in which a portable device such as a video camera is equipped with a non-directional microphone and a stereo feeling of a collected audio signal is emphasized by signal processing (see Japanese Patent Laid-Open No. 2001-189999).

However, in Japanese Patent Laid-Open No. 2001-189999, when the processing of emphasizing the stereo feeling is performed, there is a problem that a low-frequency component is greatly damped as compared to a high-frequency component. For this reason, when the level of the low-frequency component is adjusted, there is, on the other hand, a problem that noise as the low-frequency component, such as floor noise, increases.

SUMMARY

An audio processing device includes a first low-pass filter unit configured to output a low-frequency component of a first right channel audio signal; a second low-pass filter unit configured to output a low-frequency component of a first left channel audio signal; a first subtraction unit configured to subtract an output signal of the second low-pass filter unit from the first right channel audio signal, thereby outputting a second right channel audio signal; a second subtraction unit configured to subtract an output signal of the first low-pass filter unit from the first left channel audio signal, thereby outputting a second left channel audio signal; a first addition unit configured to add up the first right channel audio signal and the first left channel audio signal; a third low-pass filter unit configured to output a low-frequency component of an output signal of the first addition unit; a first amplification unit configured to amplify an output signal of the third low-pass filter unit; a control unit configured to control the amplification factor of the first amplification unit based on the second right channel audio signal and the second left channel audio signal; a second addition unit configured to add up the second right channel audio signal and an output signal of the first amplification unit; and a third addition unit configured to add up the second left channel audio signal and the output signal of the first amplification unit.

Further features of the present disclosure will become apparent from the following description of exemplary embodiments (with reference to the attached drawings).

DESCRIPTION OF THE EMBODIMENTS

First Embodiment

Figure 1:
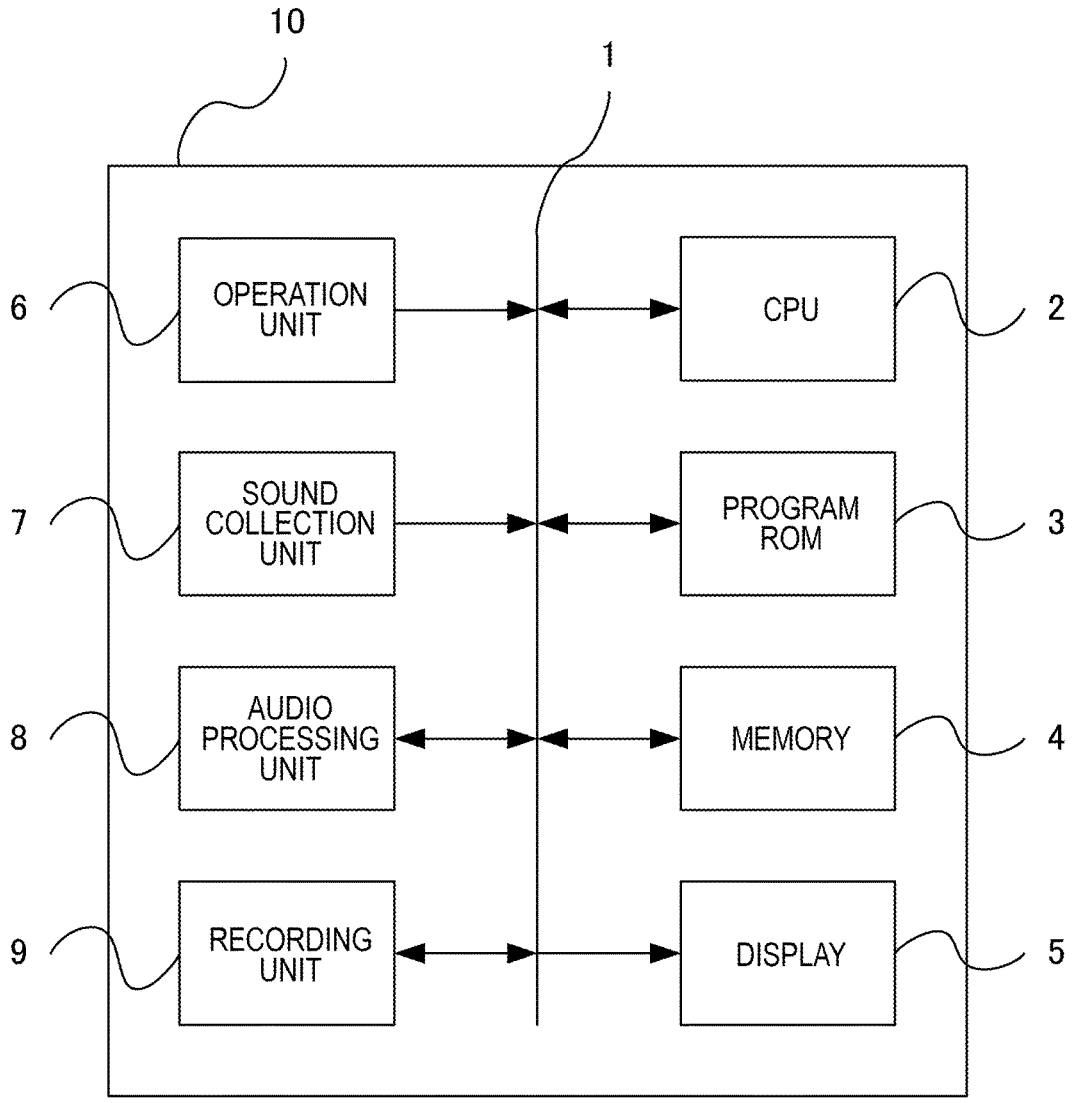
FIG. 1 is a block diagram of a configuration example of a sound collection device according to one or more aspects of the present disclosure.

FIG. 1 is a diagram of a configuration example of a sound collection device 10 according to a first embodiment of the present disclosure. The sound collection device 10 has a central processing unit (CPU) 2, a program ROM 3, a memory 4, a display 5, an operation unit 6, a sound collection unit 7, an audio processing unit 8, and a recording unit 9, these components being connected together via an internal bus 1. Note that the sound collection device 10 further has a battery, a recording medium drive, etc.

The internal bus 1 is a versatile bus for inputting/outputting various types of data, a control signal, an instruction signal, etc. to/from each block of the sound collection device 10. The CPU 2 is a calculation processing device configured to control operation of the sound collection device 10. The CPU 2 is configured to input an instruction from a user via the operation unit 6 to execute later-described various programs and to perform display control of the display 5. The program ROM 3 is configured to store data and the programs for an operation processing procedure of the CPU 2 (e.g., the programs for the processing of starting up the sound collection device 10, basic input/output processing, and each type of processing described later). The memory 4 is used as a work area of the CPU 2.

The display 5 is a display unit configured to provide a graphic user interface (GUI). The operation unit 6 is a touch panel using multiple manipulators arranged at a housing of the sound collection device 10 or employing a technique by means of a resistance film or an electrostatic capacitor on a surface of the display 5. The touch panel can instruct various types of operation input to the CPU 2 by a combination of a display image of the display 5 and a detection region of the touch panel.

The sound collection unit 7 is configured to collect audio around the sound collection device 10 by built-in microphones, thereby converting an analog audio signal of the collected audio into a digital signal and outputting the digital signal to the audio processing unit 8. The audio processing unit 8 is an audio processing device as a microcomputer configured to execute the following processing programs, and is configured to execute processing necessary for audio recording/reproduction. Alternatively, the audio processing unit 8 may be configured to execute the following processing in response to program execution by the CPU 2. The audio processing unit 8 temporarily stores, in the memory, the digital audio signal output from the sound collection unit 7, and performs stereo feeling emphasis processing. In addition, the audio processing unit 8 also performs audio processing such as the effect processing of providing a special effect to audio, level optimization processing, and noise reduction processing.

The CPU 2 outputs the audio signal processed by the audio processing unit 8 to the recording unit 9 for recording, and outputs the audio signal to a not-shown output unit for reproduced output or monitor audio output. The recording unit 9 is configured to convert the audio signal into a data format suitable for recording and to write the data in a recording medium such as a data tape, an optical disc, or a flash memory. Moreover, the recording unit 9 is configured to read the data stored in the recording medium.

Figure 2:
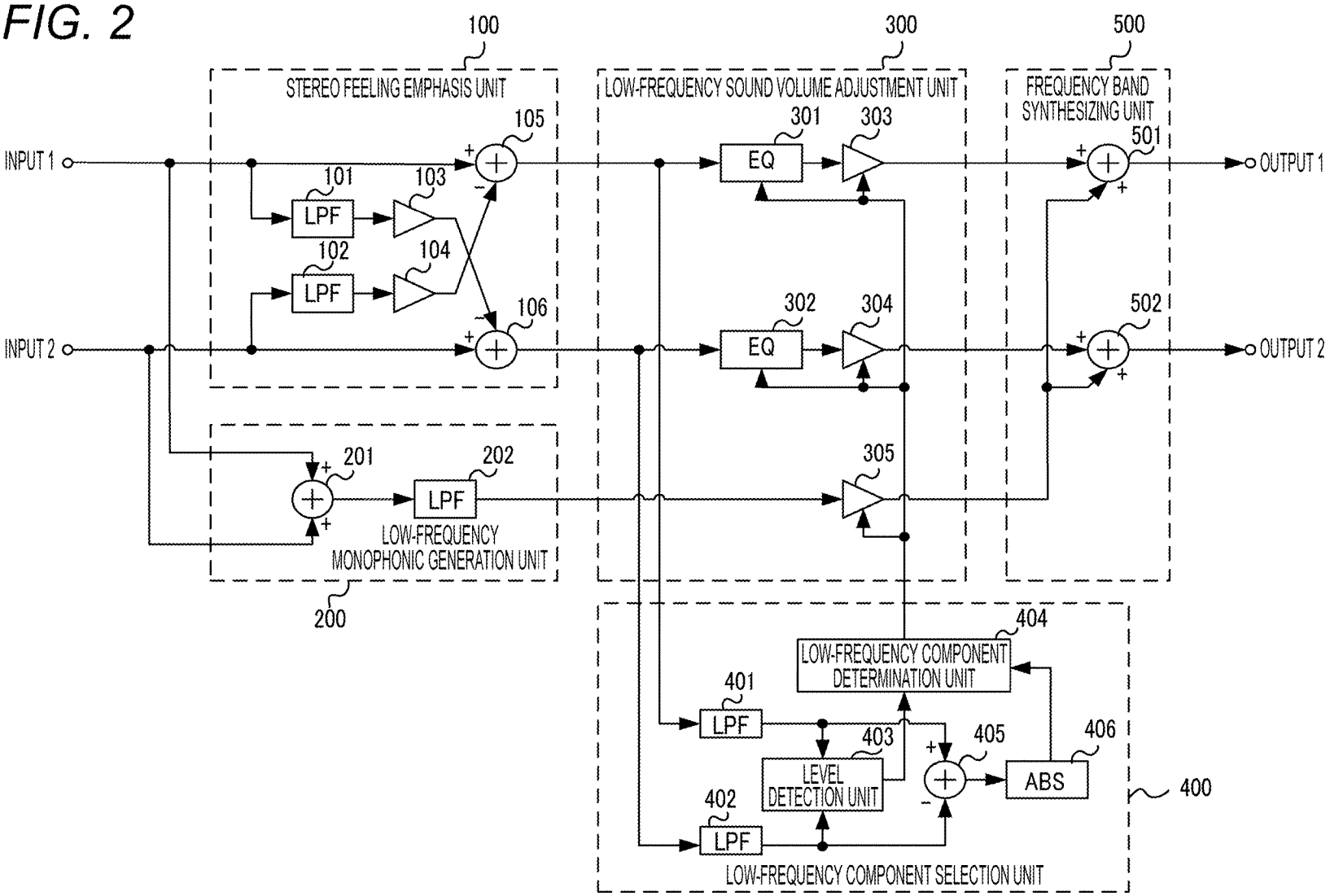
FIG. 2 is a diagram of a configuration example of an audio processing unit according to one or more aspects of the present disclosure.

FIG. 2 is a diagram of a functional configuration example of the audio processing unit 8. The audio processing unit 8 has a stereo feeling emphasis unit 100, a low-frequency monophonic generation unit 200, a low-frequency sound volume adjustment unit 300, a low-frequency component selection unit 400, and a frequency band synthesizing unit 500. The audio processing unit 8 performs the stereo feeling emphasis processing. The audio processing unit 8 inputs, as input 1 and input 2, a right channel audio signal and a left channel audio signal obtained by the sound collection unit 7. The sound collection unit 7 includes multiple non-directional microphones. The audio processing unit 8 performs, by not-shown processing blocks, signal level amplification processing, wind noise reduction processing, etc. for the audio signals obtained by the sound collection unit 7, thereby inputting the right channel audio signal (the input 1) and the left channel audio signal (the input 2).

The stereo feeling emphasis unit 100 has low-pass filters (hereinafter referred to as "LPFs") 101, 102, dampers (damping units) 103, 104, and subtracters 105, 106. The LPF 101 is configured to perform low-pass filter processing for the right channel audio signal (the input 1), thereby outputting a low-frequency component of the right channel audio signal. The LPF 102 is configured to perform the low-pass filter processing for the left channel audio signal (the input 2), thereby outputting a low-frequency component of the left channel audio signal. The damper 103 is configured to damp the output signal of the LPF 101 to a predetermined level. The damper 104 is configured to damp the output signal of the LPF 102 to a predetermined level. The subtracter 105 is configured to subtract the output signal of the damper 104 from the right channel audio signal (the input 1), thereby outputting the right channel audio signal with an emphasized stereo feeling. The subtracter 106 is configured to subtract the output signal of the damper 103 from the left channel audio signal (the input 2), thereby outputting the left channel audio signal with an emphasized stereo feeling.

Note that delay elements may be provided instead of the LPFs 101, 102. Moreover, the degree of emphasis of the stereo feeling changes according to a distance between the two non-directional microphones and settings for the cutoff frequencies of the LPFs 101, 102 and the damping rates of the dampers 103, 104.

By the processing of the stereo feeling emphasis unit 100, a signal with a smaller phase difference between the two channel audio signals is greatly damped. For audio signals at two certain points, a lower frequency results in a smaller phase difference. As described above, the stereo feeling emphasis unit 100 outputs signals whose low-frequency components have been greatly damped as compared to high-frequency components.

Figure 3:
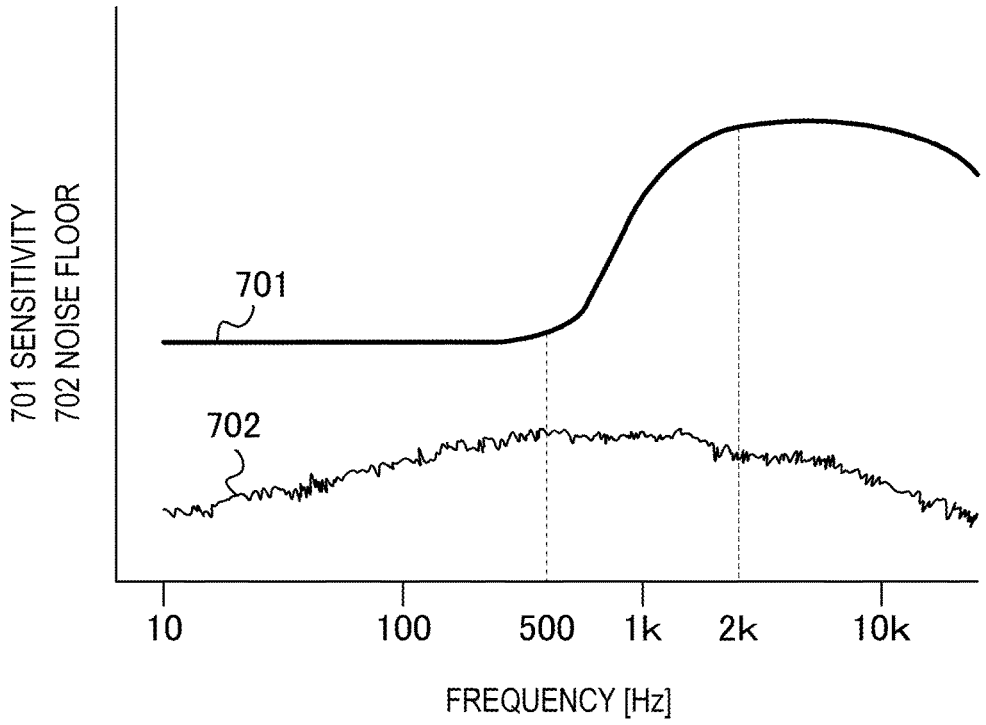
FIG. 3 shows graphs of frequency characteristics with respect to sensitivity and a noise floor level.

FIG. 3 shows graphs of an example of frequency characteristics of the output signal of the subtracter 105 with respect to sensitivity 701 and a noise floor level 702. The output signal of the subtracter 105 will be described by way of example, but the same applies to the output signal of the subtracter 106. For the sensitivity 701, the horizontal axis represents a frequency, and the vertical axis represents the level of sensitivity of the output signal with respect to the input signal. For the noise floor level 702, the horizontal axis represents the frequency, and the vertical axis represents a noise floor level. The sensitivity 701 shows that the sensitivity is lower in a low frequency range and is higher in a high frequency range and shows a changing slope within a range of about 500 Hz to about 2 kHz between the low and high frequency ranges. On the other hand, the noise floor level 702 shows that the noise level in an intermediate frequency range is relatively high and the noise level in the low frequency range is substantially equal to that in the high frequency range.

In FIG. 2, the low-frequency sound volume adjustment unit 300 has equalizers (equalizer units, hereinafter referred to as "EQs") 301, 302 and amplifiers (amplification units) 303 to 305. The EQ 301 is configured to receive the output signal of the subtracter 105, thereby correcting a sensitivity difference in the sensitivity 701 among frequency bands. The EQ 302 is configured to receive the output signal of the subtracter 106, thereby correcting a sensitivity difference in the sensitivity 701 between frequency bands. The amplifier 303 is configured to amplify the output signal of the EQ 301. The amplifier 304 is configured to amplify the output signal of the EQ 302.

Figure 4:
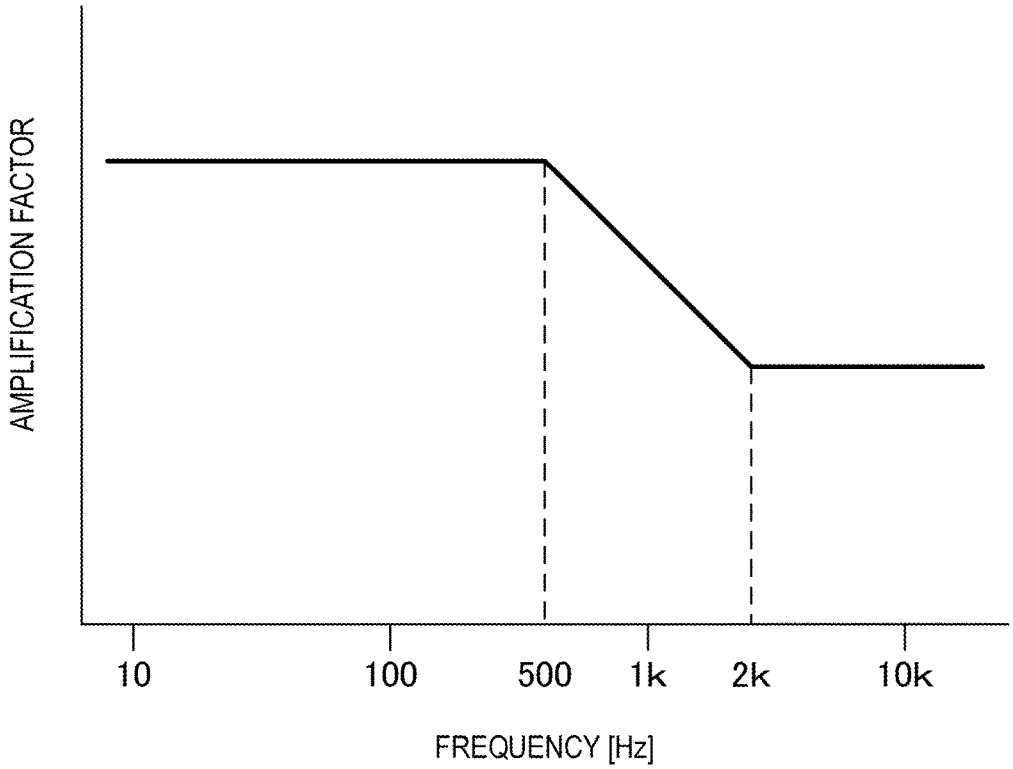
FIG. 4 shows a graph of the frequency characteristics with respect to an equalizer amplification factor.

FIG. 4 shows a graph of the frequency characteristics with respect to the amplification factor of the EQ 301. The EQ 301 will be described by way of example, but the same applies to the EQ 302. The frequency characteristics with respect to the amplification factor of the EQ 301 show, for example, such characteristics that the amplification factor changes within a range of about 500 Hz to about 2 kHz such that the changing slope of the frequency characteristics with respect to the sensitivity 701 of FIG. 3 is inverted, and also show such characteristics that the amplification factor is higher in the low frequency range and is lower in the high frequency range. The EQ 301 is configured such that a low-frequency component of the output signal of the subtracter 105 is amplified at a higher amplification factor than that of a high-frequency component. The EQ 302 is configured such that a low-frequency component of the output signal of the subtracter 106 is amplified at a higher amplification factor than that of a high-frequency component.

Note that upon digital signal processing, the EQ 301 damps, taking the amplification factor of the component with a higher amplification factor as 1, the component with a lower amplification factor for preventing the amplified data from exceeding a digital full scale. However, as a result, the high-frequency component is damped with reference to the signal level of the low-frequency component damped by the stereo feeling emphasis processing, and for this reason, the signal level is lowered across the entire frequency band. For this reason, the amplifier 303 amplifies the output signal of the EQ 301 to a proper level with the frequency characteristics being held across the entire frequency band, thereby adjusting frequency band balance. The amplifier 304 amplifies the output signal of the EQ 302 to a proper level with the frequency characteristics being held across the entire frequency band, thereby adjusting the frequency band balance.

Figure 5:
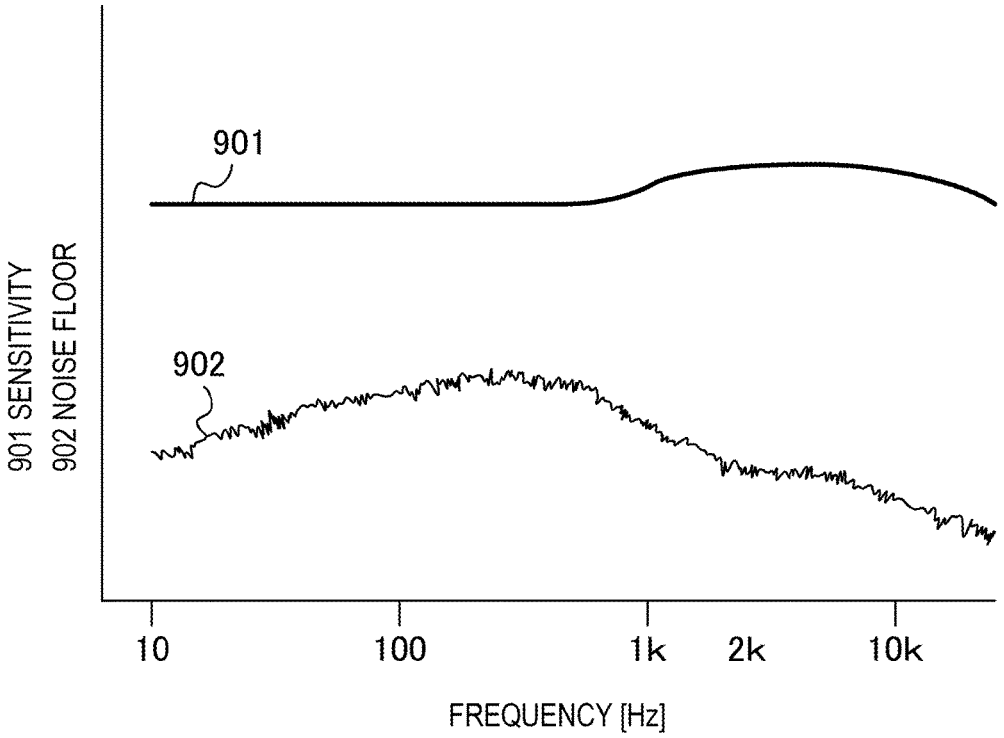
FIG. 5 shows graphs of the frequency characteristics with respect to sensitivity and a noise floor level.

FIG. 5 shows graphs of the frequency characteristics of the output signal of the amplifier 303 with respect to sensitivity 901 and a noise floor level 902. The sensitivity 901 shows a smaller difference between the low and high frequency ranges as compared to the sensitivity 701. Note that an LPF with a high cutoff frequency may be provided at a subsequent stage of each of the amplifiers 303, 304 to perform adjustment for further flattening the entire frequency band. On the other hand, the noise floor level 902 is higher on a low frequency side. This is because the damped low-frequency signal is amplified by the EQ 301, and accordingly, the noise floor level 902 is similarly elevated.

When the audio collected by the microphones is loud, the floor noise indicated by the noise floor level 902 is embedded in such collected audio, and therefore, is less captured. Thus, such noise is small enough to be ignored. On the other hand, when the audio collected by the microphones is quiet, the floor noise is easily captured. Moreover, low-frequency floor noise more easily catches one's ears as compared to high-frequency floor noise, and therefore, provides the impression of feeling louder noise.

For this reason, the frequency band synthesizing unit 500 is configured to process the audio signal such that the stereo feeling is emphasized while the floor noise becomes less noticeable. In the present embodiment, a low-frequency component with a low noise floor level is generated and utilized. The low-frequency monophonic generation unit 200 has an adder 201 and an LPF 202. The adder 201 is configured to add up the right channel audio signal (the input 1) and the left channel audio signal (the input 2), thereby outputting a monophonic signal. Since the output signal of the adder 201 is the monophonic signal obtained by simple addition, a low-frequency component is not specifically damped, and a white noise component as floor noise is damped by several dB. With this configuration, the adder 201 can provide a signal with a low noise floor level and a favorable signal-to-noise ratio. The LPF 202 is configured to perform the low-pass filter processing with a predetermined cutoff frequency for the monophonic signal output from the adder 201, thereby outputting a low-frequency component of the monophonic signal. The amplifier 305 is configured to amplify the output signal of the LPF 202 at an amplification factor set by the low-frequency component selection unit 400.

Figure 6:
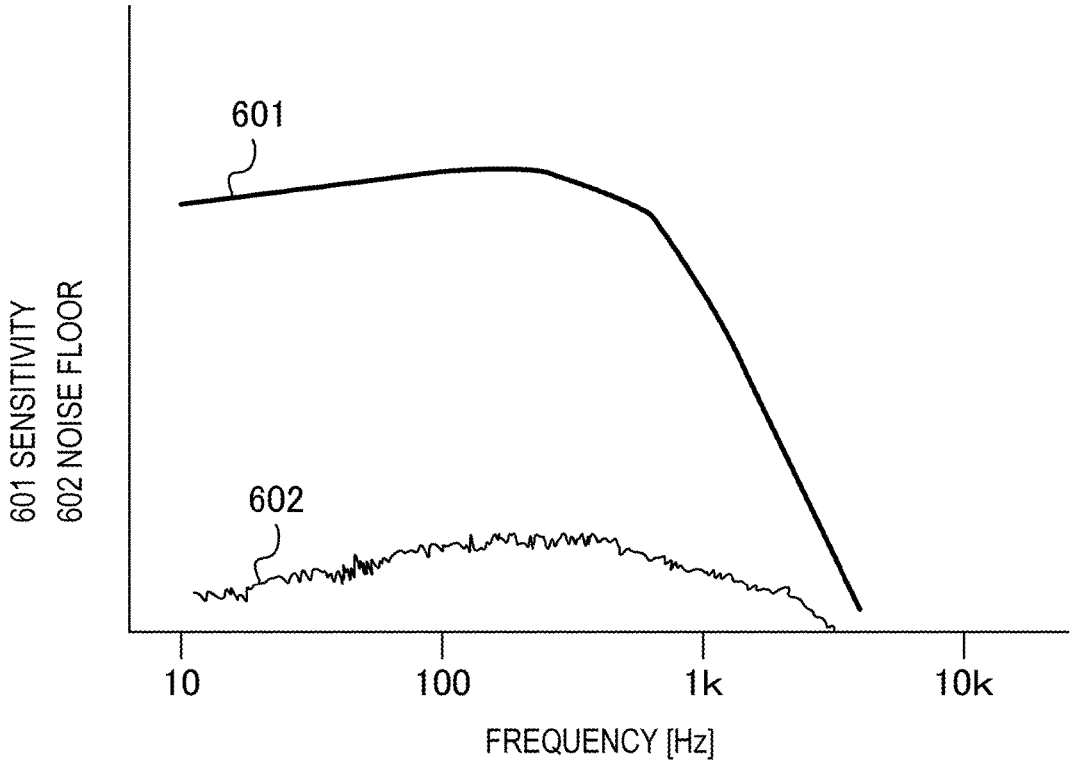
FIG. 6 shows graphs of the frequency characteristics with respect to sensitivity and a noise floor level.

FIG. 6 shows graphs of the frequency characteristics of the output signal of the LPF 202 with respect to sensitivity 601 and a noise floor level 602. The sensitivity 601 and the noise floor level 602 represent the sensitivity and noise floor level of the low-frequency component of the monophonic signal output from the LPF 202. Note that in a case where overflow of a calculation result of the adder 201 is concerned, a level converter such as a bit shift may be provided at a former stage of the adder 201. The same applies to other adders.

As described above, when the audio collected by the microphones is loud, even if the noise floor levels of the low-frequency components is elevated by correction of the EQs 301, 302, such noise is embedded in the collected audio, and therefore, is less captured. Thus, the noise is less noticeable. This state causes no problem because the stereo feeling is also provided to the low-frequency audio.

On the other hand, when the audio collected by the microphones is quiet, the floor noise is easily captured, and therefore, such an audio signal needs to be replaced with the above-described monophonic signal with a low noise floor level and a favorable signal-to-noise ratio. For this reason, in the present embodiment, the low-frequency component selection unit 400 is provided to detect the state of the input audio, thereby switching, based on a detection result, the processing between the processing of providing the audio with the stereo feeling and the processing of providing the audio with a reduced noise floor level.

The low-frequency component selection unit 400 has LPFs 401, 402, a level detection unit 403, a low-frequency component determination unit 404, a subtracter 405, and an absolute value acquisition unit (ABS) 406. The LPF 401 is configured to perform the low-pass filter processing for the output signal of the subtracter 105, thereby outputting a low-frequency component of the output signal of the subtracter 105. The LPF 402 is configured to perform the low-pass filter processing for the output signal of the subtracter 106, thereby outputting a low-frequency component of the output signal of the subtracter 106. The level detection unit 403 is configured to output, to the low-frequency component determination unit 404, a greater one of the output signals of the LPFs 401, 402. The subtracter 405 is configured to subtract the output signal of the LPF 402 from the output signal of the LPF 401. The absolute value acquisition unit 406 is configured to acquire the absolute value of the output signal of the subtracter 405, thereby outputting such an absolute value to the low-frequency component determination unit 404. That is, the absolute value acquisition unit 406 outputs a difference between the output signals of the LPFs 401, 402 to the low-frequency component determination unit 404.

The low-frequency component determination unit 404 is configured to determine the amount of low-frequency monophonic component to be multiplexed with the right and left channel audio signals based on the signal level output from the level detection unit 403 and the absolute value output from the absolute value acquisition unit 406. Moreover, the low-frequency component determination unit 404 is configured to set the amplification factors of the amplifiers 303 to 305 and the amplification factors of the EQs 301, 302 according to the determined low-frequency monophonic component amount. An example where the low-frequency component determination unit 404 performs determination based on the levels of low-frequency components of the two signals subjected to the stereo feeling emphasis processing and a level difference between these two signals will be described herein.

The frequency band synthesizing unit 500 has an adder 501 and an adder 502. The adder 501 is configured to add up the output signal of the amplifier 303 and the output signal of the amplifier 305, thereby outputting the right channel audio signal (output 1) with the emphasized stereo feeling. The adder 502 is configured to add up the output signal of the amplifier 304 and the output signal of the amplifier 305, thereby outputting the left channel audio signal (output 2) with the emphasized stereo feeling.

Figure 7:
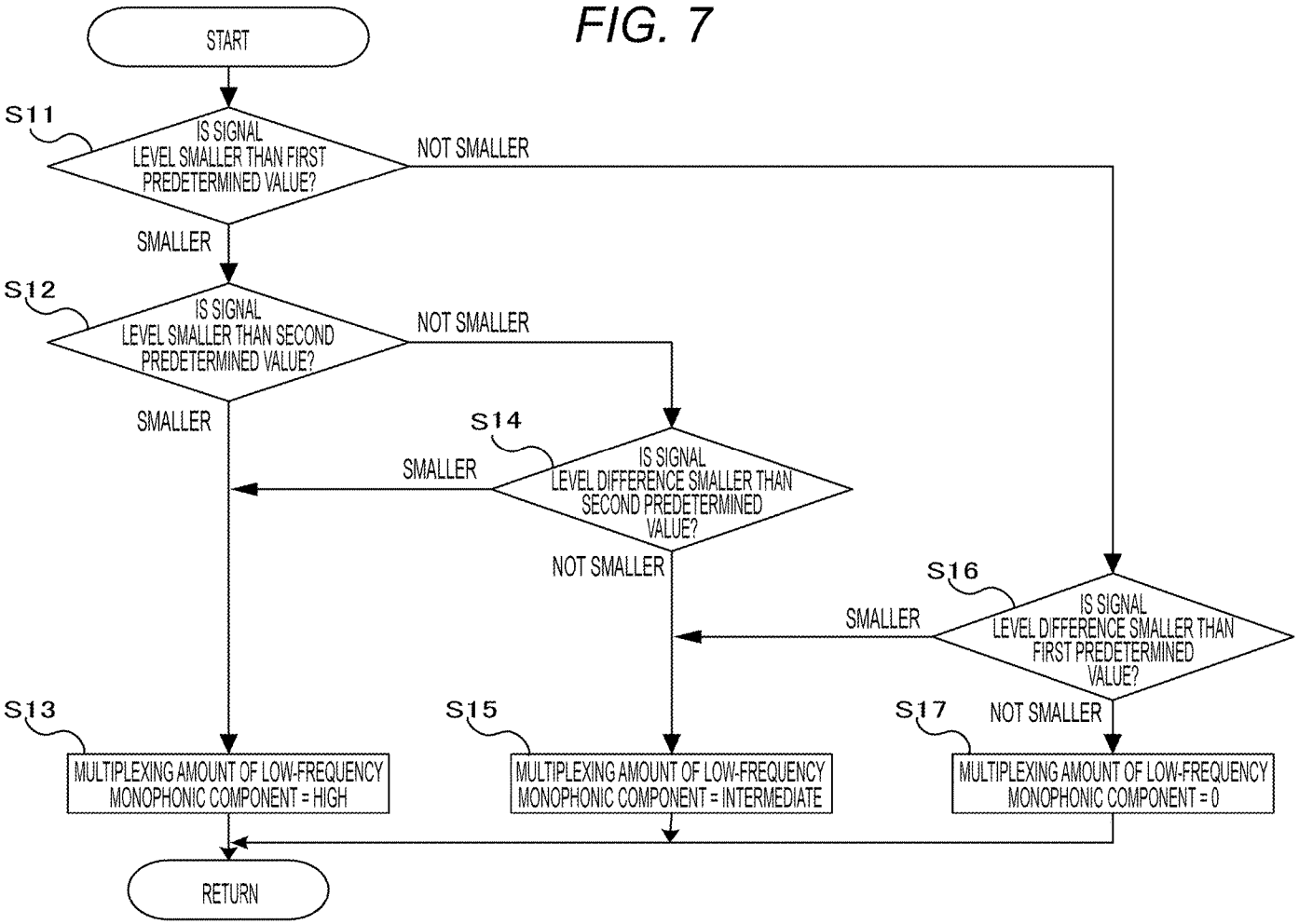
FIG. 7 is a flowchart of processing by a low-frequency component determination unit 404.

FIG. 7 is a flowchart of the processing of the low-frequency component determination unit 404. The low-frequency component determination unit 404 determines the amount of addition of the low-frequency monophonic signal to the stereo feeling emphasis processing signal. First, at a step S11, the low-frequency component determination unit 404 determines whether or not the level of signal output from the level detection unit 403 is smaller than a first predetermined value. In a case where the low-frequency component determination unit 404 determines that the signal level is smaller than the first predetermined value, the low-frequency component determination unit 404 proceeds the processing to a step S12. In a case where the low-frequency component determination unit 404 determines that the signal level is not smaller than the first predetermined value, the low-frequency component determination unit 404 proceeds the processing to a step S16.

At the step S12, the low-frequency component determination unit 404 determines whether or not the level of signal output from the level detection unit 403 is smaller than a second predetermined value. The second predetermined value is smaller than the first predetermined value. In a case where the low-frequency component determination unit 404 determines that the signal level is smaller than the second predetermined value, the low-frequency component determination unit 404 proceeds the processing to a step S13. In a case where the low-frequency component determination unit 404 determines that the signal level is not smaller than the second predetermined value, the low-frequency component determination unit 404 proceeds the processing to a step S14.

The first predetermined value described herein is such a level that the audio collected by the microphones is equivalent to 80 dBspl. The second predetermined value is such a level that the audio collected by the microphones is equivalent to 40 dBspl. These values have been described by way of example, and suitable values are set considering the noise floor level of the low-frequency component subjected to the stereo feeling emphasis processing, for example.

At the step S16, the low-frequency component determination unit 404 determines whether or not the absolute value output from the absolute value acquisition unit 406 is smaller than a first predetermined value. In a case where the low-frequency component determination unit 404 determines that the absolute value is smaller than the first predetermined value, the low-frequency component determination unit 404 proceeds the processing to a step S15. In a case where the low-frequency component determination unit 404 determines that the absolute value is not smaller than the first predetermined value, the low-frequency component determination unit 404 proceeds the processing to a step S17.

At the step S14, the low-frequency component determination unit 404 determines whether or not the absolute value output from the absolute value acquisition unit 406 is smaller than a second predetermined value. In a case where the low-frequency component determination unit 404 determines that the absolute value is smaller than the second predetermined value, the low-frequency component determination unit 404 proceeds the processing to the step S13. In a case where the low-frequency component determination unit 404 determines that the absolute value is not smaller than the second predetermined value, the low-frequency component determination unit 404 proceeds the processing to the step S15.

At the step S13, the low-frequency component determination unit 404 determines that the signal level of the low-frequency component is lowest, and sets the amplification factors of the EQs 301, 302 and the amplifiers 303 to 305 such that a great amount of low-frequency monophonic signal to be multiplexed with the right and left channel audio signals is set. The amplification factor of the amplifier 305 is increased. For example, the EQs 301, 302 output, without correction, the signals with the damped low frequency components. The amplifiers 303 to 305 adjust the frequency band balance such that the damped low frequency components output from the EQs 301, 302 are complemented with the monophonic component output from the LPF 202. At this point, the adder 501 adds up the signal output with the characteristics of FIG. 3 from the amplifier 303 and the signal output with the characteristics of FIG. 6 from the amplifier 305, thereby outputting the signal with the characteristics of FIG. 8.

Figure 8:
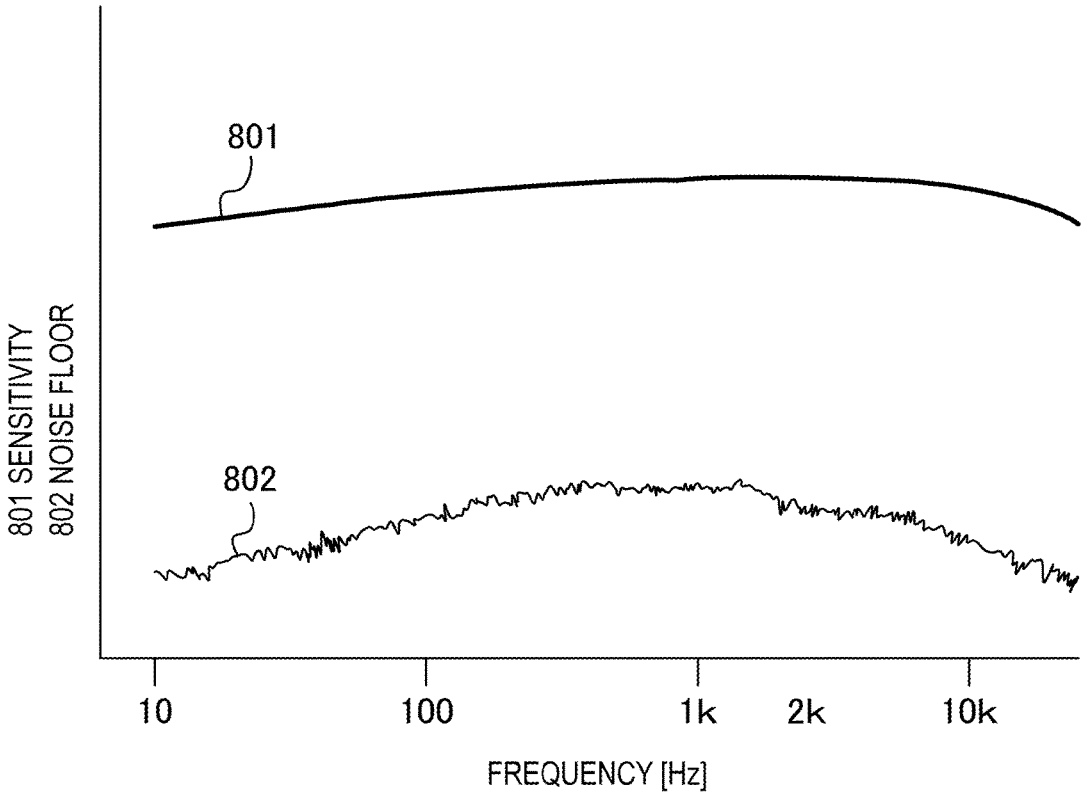
FIG. 8 shows graphs of the frequency characteristics with respect to sensitivity and a noise floor level.

FIG. 8 shows graphs of the frequency characteristics of the output signal of the adder 501 with respect to sensitivity 801 and a noise floor level 802. The same applies to the output signal of the adder 502 and the output signal of the adder 501. The adder 501 adds up the output signal of the amplifier 303 and the output signal of the amplifier 305. The sensitivity 801 shows more improved sensitivity balance between the high and low frequency ranges as compared to the sensitivity 901 of FIG. 5. The noise floor level 802 shows that the noise floor level in the low frequency range is held at a lower state as compared to the noise floor level 902 of FIG. 5.

At the step S17, the low-frequency component determination unit 404 sets the amplification factors of the EQs 301, 302 and the amplifiers 303 to 305 such that the amount of low-frequency monophonic signal to be multiplexed with the right and left channel audio signals is zero. The amplification factor of the amplifier 305 is zero. The adders 501, 502 each output only the components subjected to the stereo feeling emphasis processing without multiplexing the low-frequency monophonic signal output from the amplifier 305 with the output signals of the amplifiers 303, 304.

At the step S15, the low-frequency component determination unit 404 determines as lack of the stereo feeling, and sets the amplification factors of the EQs 301, 302 and the amplifiers 303 to 305 such that the amount of low-frequency monophonic signal to be multiplexed with the right and left channel audio signals is at an intermediate level. The amplification factor of the amplifier 305 is set at an intermediate level. The adders 501, 502 each multiplex the low-frequency monophonic signal output from the amplifier 305 with the right and left channel audio signals output from the amplifiers 303, 304, thereby reducing a noise feeling.

Note that as described above, the determination conditions of the steps S14 and S16 can be omitted. For example, at the step S11, in a case where the low-frequency component determination unit 404 determines that the level of signal output from the level detection unit 403 is not smaller than the first predetermined value, the low-frequency component determination unit 404 proceeds the processing to the step S17. At the step S12, in a case where the low-frequency component determination unit 404 determines that the level of signal output from the level detection unit 403 is not smaller than the second predetermined value, the low-frequency component determination unit 404 proceeds the processing to the step S15. In this case, the low-frequency component determination unit 404 sets the amplification factors of the EQs 301, 302 and the amplifiers 303 to 305 according to the level of signal output from the level detection unit 403.

The low-frequency component determination unit 404 controls the amplification factors of the amplifiers 303 to 305 such that the amplification factor of the amplifier 305 increases and the amplification factors of the amplifiers 303, 304 decrease with a decrease in the level of signal output from the level detection unit 403.

With the output signal of the absolute value acquisition unit 406 as the added determination condition, the low-frequency component determination unit 404 can more finely determine the effect of use of the stereo feeling emphasized signal for the low-frequency component. Note that the determination condition which is the output signal of the absolute value acquisition unit 406 does not provide, in terms of which one of the collected audio or the floor noise is more easily captured, much influence as compared to the determination condition which is the level of signal output from the level detection unit 403. Thus, even when the determination condition which is the output signal of the absolute value acquisition unit 406 is omitted, a proper effect can be expected.

The low-frequency component determination unit 404 may use the output signal of the LPF 202 instead of the output signal of the level detection unit 403. In this case, the low-frequency component determination unit 404 sets the amplification factors of the amplifiers 303 to 305 and the amplification factors of the EQs 301, 302 based on the output signal of the LPF 202 and the output signal of the absolute value acquisition unit 406. That is, the low-frequency component determination unit 404 sets the amplification factors of the amplifiers 303 to 305 and the amplification factors of the EQs 301, 302 based on the low-frequency component of the monophonic signal output from the LPF 202 and a difference between the output signals of the LPFs 401, 402.

The steps S14 and S16 may be omitted, and the low-frequency component determination unit 404 may set the amplification factors of the amplifiers 303 to 305 and the amplification factors of the EQs 301, 302 based on the output signal of the LPF 202. That is, the low-frequency component determination unit 404 may sets the amplification factors of the amplifiers 303 to 305 and the amplification factors of the EQs 301, 302 based on the low-frequency component of the monophonic signal output from the LPF 202.

The low-frequency component determination unit 404 controls the amplification factors of the amplifiers 303 to 305 such that the amplification factor of the amplifier 305 increases and the amplification factors of the amplifiers 303, 304 decrease with a decrease in the level of signal output from the LPF 202.

Note that at the step S17, the low-frequency component determination unit 404 sets, to zero, the amount of low-frequency monophonic component to be multiplexed, but may set such that the amount of low-frequency monophonic component to be multiplexed is smaller than that of the step S15.

Note that a greater number of predetermined values for comparison with the signal level and predetermined values for comparison with the absolute value can result in more detailed control steps for the amount of low-frequency monophonic signal to be multiplexed. Conversely, a smaller number of predetermined values for comparison with the signal level and predetermined values for comparison with the absolute value can change the amount of low-frequency monophonic signal to be multiplexed only in a limited state. For example, at the step S16, the first predetermined value is set to zero. In this case, when the signal level is greater than the first predetermined value, the processing inevitably proceeds to the step S17, and the adders 501, 502 can output only the components subjected to the stereo feeling emphasis processing without multiplexing of the low-frequency monophonic signal.

Note that in a case where each of the adders 501, 502 mixes both of the low-frequency component subjected to the stereo feeling emphasis processing and the low-frequency monophonic signal, the low-frequency component determination unit 404 also adjusts the amplification factors of the EQs 301, 302 according to the amount of low-frequency monophonic signal to be multiplexed. That is, when the amount of low-frequency monophonic signal to be multiplexed is great, the low-frequency component determination unit 404 decreases the amplification factors of the EQs 301, 302, thereby reducing elevation of the noise floor level. When the amplification factors of the EQs 301, 302 are changed, the output levels of the EQs 301, 302 are also changed. Thus, according to such a change, the amplification factors of the amplifiers 303, 304 are also adjusted.

The amplifiers 303 to 305 can be used to resemble the volume control for adjusting the output amount of each signal. Thus, when the amount of low-frequency monophonic signal to be multiplexed is changed, a time constant is applied to a change in the output levels of the amplifiers 303 to 305, and a change is made such that a stereo component and a monophonic component are cross-faded. This can ease a rapid change in noise floor and directional characteristics.

The adder 501 adds up the output signal of the amplifier 303 and the output signal of the amplifier 305, thereby outputting the right channel audio signal (the output 1) with the emphasized stereo feeling. The adder 502 adds up the output signal of the amplifier 304 and the output signal of the amplifier 305, thereby outputting the left channel audio signal (the output 2) with the emphasized stereo feeling.

According to the present embodiment, the audio processing unit 8 can output the audio with reduced low-frequency floor noise when the audio collected by the microphones is quiet, and can output the audio with the emphasized stereo feeling even in the low frequency range when the audio collected by the microphones is loud.

Second Embodiment

Figure 9:
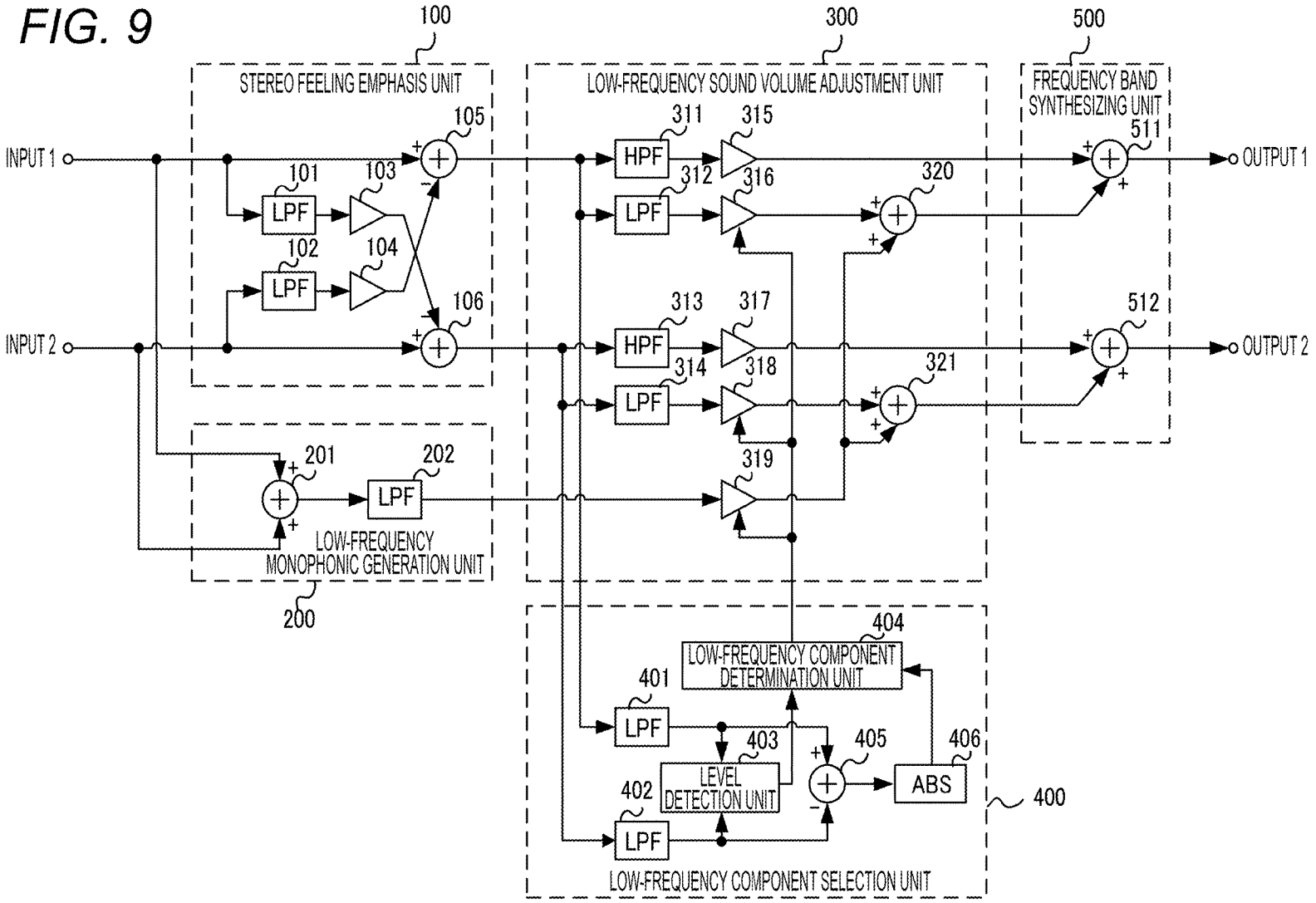
FIG. 9 is a diagram of a configuration example of an audio processing unit according to one or more aspects of the present disclosure.

FIG. 9 is a diagram of a function configuration example of an audio processing unit 8 according to a second embodiment of the present disclosure. The audio processing unit 8 of FIG. 2 of the first embodiment has the EQs 301, 302, but the audio processing unit 8 of FIG. 9 of the second embodiment has no EQs 301, 302. The audio processing unit 8 of FIG. 9 is similar to the audio processing unit 8 of FIG. 2 in a stereo feeling emphasis unit 100, a low-frequency monophonic generation unit 200, and a low-frequency component selection unit 400, and is different from the audio processing unit 8 of FIG. 2 in a low-frequency sound volume adjustment unit 300 and a frequency band synthesizing unit 500. Hereinafter, differences of the present embodiment from the first embodiment will be described.

The low-frequency sound volume adjustment unit 300 has high-pass filters (high-pass filter units, hereinafter referred to as "HPFs") 311, 313, LPFs (Low-pass filter units) 312, 314, amplifiers 315 to 319, and adders 320, 321. The HPF 311 is configured to perform high-pass filter processing with a predetermined cutoff frequency for an output signal of a subtracter 105, thereby outputting a high-frequency component of the output signal of the subtracter 105. The HPF 313 is configured to perform the high-pass filter processing with a predetermined cutoff frequency for an output signal of a subtracter 106, thereby outputting a high-frequency component of the output signal of the subtracter 106. The LPF 312 is configured to perform low-pass filter processing with a predetermined cutoff frequency for the output signal of the subtracter 105, thereby outputting a low-frequency component of the output signal of the subtracter 105. The LPF 314 is configured to perform the low-pass filter processing with a predetermined cutoff frequency for the output signal of the subtracter 106, thereby outputting a low-frequency component of the output signal of the subtracter 106.

The cutoff frequencies of the HPFs 311, 313 and the LPFs 312, 314 are set considering easiness of adjustment in a case where a frequency band for which a stereo feeling needs to be left upon multiplexing of a low-frequency monophonic signal is adjusted or frequency characteristics are adjusted at a subsequent stage of the frequency band synthesizing unit 500. In a case where the output signals of the subtracters 105, 106 show the frequency characteristics shown in FIG. 4, the cutoff frequencies are set within a range of 500 to 2 kHz. Note that considering the above-described point, when other frequencies are proper, the cutoff frequencies may be set accordingly. Moreover, when the same cutoff frequency of the LPFs 312, 314 is applied to the cutoff frequency of the LPF 202, low-frequency components with equivalent frequency bands are provided via each LPF.

The amplifier 315 is configured to amplify the output signal of the HPF 311. The amplifier 316 is configured to amplify the output signal of the LPF 312. The amplifier 317 is configured to amplify the output signal of the HPF 313. The amplifier 318 is configured to amplify the output signal of the LPF 314. The amplifier 319 is configured to amplify the output signal of the LPF 202. The amplifiers 315, 317 amplify the high-frequency components of the signals, and therefore, the amplification factors of the amplifiers 315, 317 are fixed regardless of the amount of multiplexing of the low-frequency monophonic signal. On the other hand, the amplifiers 316, 318, 319 change the amplification factors thereof according to the amount of multiplexing of the low-frequency monophonic signal.

As in the processing of the flowchart of FIG. 7, a low-frequency component determination unit 404 determines the amount of multiplexing of the low-frequency monophonic signal, and sets the amplification factors of the amplifiers 316, 318, 319. The low-frequency component determination unit 404 decreases the amplification factors of the amplifiers 316, 318 for increasing the amplification factor of the amplifier 319, and increases the amplification factors of the amplifiers 316, 318 for decreasing the amplification factor of the amplifier 319. A time constant is applied to a change in the amplification factors of the amplifiers 316, 318, 319, and a change is made such that a stereo component and a monophonic component are cross-faded. This can ease a rapid change in noise floor and directional characteristics.

The adder 320 is configured to add up the output signal of the amplifier 316 and the output signal of the amplifier 319, thereby outputting a low-frequency component of a right channel audio signal. The adder 321 is configured to add up the output signal of the amplifier 318 and the output signal of the amplifier 319, thereby outputting a low-frequency component of a left channel audio signal.

The frequency band synthesizing unit 500 has an adder 511 and an adder 512. The adder 511 is configured to add up the output signal of the amplifier 315 and the output signal of the adder 320, thereby outputting the right channel audio signal (output 1) with the entire frequency band. The adder 512 is configured to add up the output signal of the amplifier 317 and the output signal of the adder 321, thereby outputting the left channel audio signal (output 2) with the entire frequency band. The output signals of the adders 511, 512 show the frequency characteristics with respect to the sensitivity 801 and the noise floor level 802 as shown in FIG. 8.

Note that in the low-frequency component selection unit 400, the signal low-frequency components targeted for level detection of a level detection unit 403 and subtraction of a subtracter 405 are the same as those for which gain adjustment needs to be performed by the amplifiers 316, 318. Thus, in the low-frequency component selection unit 400, the level detection unit 403 and the subtracter 405 can each perform level detection and subtraction based on the output signals of the LPFs 312, 314. In this case, the LPFs 401, 402 can be omitted.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2017-099887, filed May 19, 2017, which is hereby incorporated by reference herein in its entirety.

What is claimed is:

1. An audio processing device comprising:

a first low-pass filter unit configured to output a low-frequency component of a first right channel audio signal;

a second low-pass filter unit configured to output a low-frequency component of a first left channel audio signal;

a first subtraction unit configured to subtract an output signal of the second low-pass filter unit from the first right channel audio signal, thereby outputting a second right channel audio signal;

a second subtraction unit configured to subtract an output signal of the first low-pass filter unit from the first left channel audio signal, thereby outputting a second left channel audio signal;

a first addition unit configured to add up the first right channel audio signal and the first left channel audio signal;

a third low-pass filter unit configured to output a low-frequency component of an output signal of the first addition unit;

a first amplification unit configured to amplify an output signal of the third low-pass filter unit;

a control unit configured to control an amplification factor of the first amplification unit based on the second right channel audio signal and the second left channel audio signal;

a second addition unit configured to add up the second right channel audio signal and an output signal of the first amplification unit; and a third addition unit configured to add up the second left channel audio signal and the output signal of the first amplification unit.

2. The audio processing device according to claim 1, wherein the control unit increases the amplification factor of the first amplification unit with a decrease in levels of low-frequency components of the second right channel audio signal and the second left channel audio signal.

3. The audio processing device according to claim 1, wherein the control unit has a fourth low-pass filter unit configured to output a low-frequency component of the second right channel audio signal, and a fifth low-pass filter unit configured to output a low-frequency component of the second left channel audio signal, and the amplification factor of the first amplification unit is determined according to a greater one of levels of output signals of the fourth low-pass filter unit and the fifth low-pass filter unit.

4. The audio processing device according to claim 3, wherein the control unit determines the amplification factor of the first amplification unit according to the greater one of the levels of the output signals of the fourth low-pass filter unit and the fifth low-pass filter unit and a difference between the output signals of the fourth low-pass filter unit and the fifth low-pass filter unit.

5. The audio processing device according to claim 1, further comprising:

a first equalizer unit configured to amplify the second right channel audio signal such that an amplification factor is higher for a low-frequency component than for a high-frequency component; and a second equalizer unit configured to amplify the second left channel audio signal such that an amplification factor is higher for a low-frequency component than for a high-frequency component, wherein the second addition unit adds up an output signal of the first equalizer unit and the output signal of the first amplification unit, and the third addition unit adds up an output signal of the second equalizer unit and the output signal of the first amplification unit.

6. The audio processing device according to claim 5, further comprising:

a second amplification unit configured to amplify the output signal of the first equalizer unit; and a third amplification unit configured to amplify the output signal of the second equalizer unit, wherein the second addition unit adds up an output signal of the second amplification unit and the output signal of the first amplification unit, and the third addition unit adds up an output signal of the third amplification unit and the output signal of the first amplification unit.

7. The audio processing device according to claim 6, wherein the control unit controls an amplification factor of the second amplification unit and an amplification factor of the third amplification unit such that the amplification factor of the second amplification unit and the amplification factor of the third amplification unit decrease with an increase in the amplification factor of the first amplification unit.

8. The audio processing device according to claim 1, further comprising:

a first high-pass filter unit configured to output a high-frequency component of the second right channel audio signal;

a second high-pass filter unit configured to output a high-frequency component of the second left channel audio signal;

a sixth low-pass filter unit configured to output a low-frequency component of the second right channel audio signal; and a seventh low-pass filter unit configured to output a low-frequency component of the second left channel audio signal, wherein the second addition unit has a fourth addition unit configured to add up an output signal of the sixth low-pass filter unit and the output signal of the first amplification unit, and a fifth addition unit configured to add up an output signal of the first high-pass filter unit and an output signal of the fourth addition unit, and the third addition unit has a sixth addition unit configured to add up an output signal of the seventh low-pass filter unit and the output signal of the first amplification unit, and a seventh addition unit configured to add up an output signal of the second high-pass filter unit and an output signal of the sixth addition unit.

9. The audio processing device according to claim 8, further comprising:

a second amplification unit configured to amplify the output signal of the first high-pass filter unit;

a third amplification unit configured to amplify the output signal of the sixth low-pass filter unit;

a fourth amplification unit configured to amplify the output signal of the second high-pass filter unit; and a fifth amplification unit configured to amplify the output signal of the seventh low-pass filter unit, wherein the fourth addition unit adds up an output signal of the third amplification unit and the output signal of the first amplification unit, the fifth addition unit adds up an output signal of the second amplification unit and the output signal of the fourth addition unit, the sixth addition unit adds up an output signal of the fifth amplification unit and the output signal of the first amplification unit, and the seventh addition unit adds up an output signal of the fourth amplification unit and the output signal of the sixth addition unit.

10. The audio processing device according to claim 1, further comprising:

a first damping unit configured to damp the output signal of the first low-pass filter unit; and a second damping unit configured to damp the output signal of the second low-pass filter unit, wherein the first subtraction unit subtracts an output signal of the second damping unit from the first right channel audio signal, and the second subtraction unit subtracts an output signal of the first damping unit from the first left channel audio signal.

11. An audio processing device comprising:

a first low-pass filter unit configured to output a low-frequency component of a first right channel audio signal;

a second low-pass filter unit configured to output a low-frequency component of a first left channel audio signal;

a first subtraction unit configured to subtract an output signal of the second low-pass filter unit from the first right channel audio signal, thereby outputting a second right channel audio signal;

a second subtraction unit configured to subtract an output signal of the first low-pass filter unit from the first left channel audio signal, thereby outputting a second left channel audio signal;

a first addition unit configured to add up the first right channel audio signal and the first left channel audio signal;

a third low-pass filter unit configured to output a low-frequency component of an output signal of the first addition unit;

a first amplification unit configured to amplify an output signal of the third low-pass filter unit;

a control unit configured to control an amplification factor of the first amplification unit based on a level of the output signal of the third low-pass filter unit;

a second addition unit configured to add up the second right channel audio signal and an output signal of the first amplification unit; and a third addition unit configured to add up the second left channel audio signal and the output signal of the first amplification unit.

12. The audio processing device according to claim 11, wherein the control unit has a fourth low-pass filter unit configured to output a low-frequency component of the second right channel audio signal, and a fifth low-pass filter unit configured to output a low-frequency component of the second left channel audio signal, and the amplification factor of the first amplification unit is controlled according to the level of the output signal of the third low-pass filter unit and a difference between output signals of the fourth low-pass filter unit and the fifth low-pass filter unit.

13. The audio processing device according to claim 11, wherein the control unit increases the amplification factor of the first amplification unit with a decrease in the level of the output signal of the third low-pass filter unit.

14. The audio processing device according to claim 11, further comprising:

a first equalizer unit configured to amplify the second right channel audio signal such that an amplification factor is higher for a low-frequency component than for a high-frequency component; and a second equalizer unit configured to amplify the second left channel audio signal such that an amplification factor is higher for a low-frequency component than for a high-frequency component, wherein the second addition unit adds up an output signal of the first equalizer unit and the output signal of the first amplification unit, and the third addition unit adds up an output signal of the second equalizer unit and the output signal of the first amplification unit.

15. The audio processing device according to claim 14, further comprising:

a second amplification unit configured to amplify the output signal of the first equalizer unit; and a third amplification unit configured to amplify the output signal of the second equalizer unit, wherein the second addition unit adds up an output signal of the second amplification unit and the output signal of the first amplification unit, and the third addition unit adds up an output signal of the third amplification unit and the output signal of the first amplification unit.

16. The audio processing device according to claim 15, wherein the control unit controls an amplification factor of the second amplification unit and an amplification factor of the third amplification unit such that the amplification factor of the second amplification unit and the amplification factor of the third amplification unit decrease with an increase in the amplification factor of the first amplification unit.

17. The audio processing device according to claim 11, further comprising:

a first high-pass filter unit configured to output a high-frequency component of the second right channel audio signal;

a second high-pass filter unit configured to output a high-frequency component of the second left channel audio signal;

a sixth low-pass filter unit configured to output a low-frequency component of the second right channel audio signal; and a seventh low-pass filter unit configured to output a low-frequency component of the second left channel audio signal, wherein the second addition unit has a fourth addition unit configured to add up an output signal of the sixth low-pass filter unit and the output signal of the first amplification unit, and a fifth addition unit configured to add up an output signal of the first high-pass filter unit and an output signal of the fourth addition unit, and the third addition unit has a sixth addition unit configured to add up an output signal of the seventh low-pass filter unit and the output signal of the first amplification unit, and a seventh addition unit configured to add up an output signal of the second high-pass filter unit and an output signal of the sixth addition unit.

18. The audio processing device according to claim 17, further comprising:

a second amplification unit configured to amplify the output signal of the first high-pass filter unit;

a third amplification unit configured to amplify the output signal of the sixth low-pass filter unit;

a fourth amplification unit configured to amplify the output signal of the second high-pass filter unit; and a fifth amplification unit configured to amplify the output signal of the seventh low-pass filter unit, wherein the fourth addition unit adds up an output signal of the third amplification unit and the output signal of the first amplification unit, the fifth addition unit adds up an output signal of the second amplification unit and the output signal of the fourth addition unit, the sixth addition unit adds up an output signal of the fifth amplification unit and the output signal of the first amplification unit, and the seventh addition unit adds up an output signal of the fourth amplification unit and the output signal of the sixth addition unit.

19. The audio processing device according to claim 11, further comprising:

a first damping unit configured to damp the output signal of the first low-pass filter unit; and a second damping unit configured to damp the output signal of the second low-pass filter unit, wherein the first subtraction unit subtracts an output signal of the second damping unit from the first right channel audio signal, and the second subtraction unit subtracts an output signal of the first damping unit from the first left channel audio signal.

20. An audio processing method comprising:

a first low-pass filter step of outputting a low-frequency component of a first right channel audio signal by a first low-pass filter unit;

a second low-pass filter step of outputting a low-frequency component of a first left channel audio signal by a second low-pass filter unit;

a first subtraction step of subtracting, by a first subtraction unit, an output signal of the second low-pass filter unit from the first right channel audio signal, thereby outputting a second right channel audio signal;

a second subtraction step of subtracting, by a second subtraction unit, an output signal of the first low-pass filter unit from the first left channel audio signal, thereby outputting a second left channel audio signal;

a first addition step of adding up, by a first addition unit, the first right channel audio signal and the first left channel audio signal;

a third low-pass filter step of outputting, by a third low-pass filter unit, a low-frequency component of an output signal of the first addition unit;

a first amplification step of amplifying, by a first amplification unit, an output signal of the third low-pass filter unit;

a control step of controlling, by a control unit, an amplification factor of the first amplification unit based on the second right channel audio signal and the second left channel audio signal;

a second addition step of adding up, by a second addition unit, the second right channel audio signal and an output signal of the first amplification unit; and a third addition step of adding up, by a third addition unit, the second left channel audio signal and the output signal of the first amplification unit.

21. An audio processing method comprising:

a first low-pass filter step of outputting a low-frequency component of a first right channel audio signal by a first low-pass filter unit;

a second low-pass filter step of outputting a low-frequency component of a first left channel audio signal by a second low-pass filter unit;

a first subtraction step of subtracting, by a first subtraction unit, an output signal of the second low-pass filter unit from the first right channel audio signal, thereby outputting a second right channel audio signal;

a second subtraction step of subtracting, by a second subtraction unit, an output signal of the first low-pass filter unit from the first left channel audio signal, thereby outputting a second left channel audio signal;

a first addition step of adding up, by a first addition unit, the first right channel audio signal and the first left channel audio signal;

a third low-pass filter step of outputting, by a third low-pass filter unit, a low-frequency component of an output signal of the first addition unit;

a first amplification step of amplifying, by a first amplification unit, an output signal of the third low-pass filter unit;

a control step of controlling, by a control unit, an amplification factor of the first amplification unit based on a level of the output signal of the third low-pass filter unit;

a second addition step of adding up, by a second addition unit, the second right channel audio signal and an output signal of the first amplification unit; and a third addition step of adding up, by a third addition unit, the second left channel audio signal and the output signal of the first amplification unit.

* * * * *